United States Patent [19]

Jacobson

[11] 4,025,152

[45] May 24, 1977

[54] ELECTRICAL TERMINAL CONNECTOR

[76] Inventor: Arnold N. Jacobson, 1535 Big Horn Ave., Sheridan, Wyo. 82801

[22] Filed: Nov. 3, 1975

[21] Appl. No.: 628,517

[52] U.S. Cl. ..... 339/246; 339/263 R; 403/344

[51] Int. Cl.² ..... H01R 9/10

[58] Field of Search ..... 339/246, 249 A, 263, 339/266, 269, 271; 403/344

[56] References Cited

UNITED STATES PATENTS

| | | | |
|---|---|---|---|
| 1,122,028 | 12/1914 | Parker | 339/246 |
| 2,109,073 | 2/1938 | Nieman | 339/246 |
| 2,651,026 | 9/1953 | Roth | 339/246 |
| 3,895,878 | 7/1975 | Pitner | 403/344 |

FOREIGN PATENTS OR APPLICATIONS

| | | | |
|---|---|---|---|
| 1,002,660 | 11/1951 | France | 339/263 R |
| 1,161,058 | 3/1958 | France | 339/246 |
| 883,150 | 3/1943 | France | 339/246 |

*Primary Examiner*—Joseph H. McGlynn

[57] ABSTRACT

Electrical terminal connector characterized by a loop-like member comprising parallel legs joined at their ends by bight portions and aligned apertures extending through the legs between ends thereof for receiving a screw adapted to squeeze the legs toward each other. In one version, one end of a wire may be clamped between the legs in the locus between the screw and one bight. In another version, ends of two wires may be clamped, each between the screw and one of the bights.

3 Claims, 8 Drawing Figures

ELECTRICAL TERMINAL CONNECTOR

BACKGROUND OF THE INVENTION

Many types of electrical connectors have been proposed and used for establishing electrical contact between a wire end and a terminal to which it is connected. So-called "solder lugs" or "crimp lugs" are familiar, to which the wire end is suitably secured and the lug affixed to a terminal by a headed screw which extends through an aperture in the lug. While these devices provide excellent electrical and mechanical connection, they are expensive and require extra labor to apply some to wire ends. To obviate these disadvantages, the wire end is often secured directly to the terminal by a screw, the wire being bent, usually into a partial loop surrounding the screw and disposed between the screw head and terminal. The loop is essential so that the screw head has a bearing about at least 180° of its periphery to prevent eccentric forces on the screw tending to bend it. When it is desired to remove the wire from the screw, the loop must often be straightened or the screw completely removed which, in some cases, is impossible, since the screw may be staked to the terminal to prevent ready removal. Such screw connectors are commonly used in building wiring such as in switches, outlets, and other fixtures. As will be apparent, if the head of the screw could provide a like bearing to prevent eccentric forces thereon and the wire end be left straight, rather than bent into a loop or hook, this would be advantageous, since nothing more than the always necessary paring of the insulation on the wire end would be required. Also, elimination of the loop would reduce installation and removal labor.

When it is desired to connect two wire ends between the screw head and terminal, it is common practice to provide a loop in each wire and stack the loops between the terminal and screw head. In some instances, the screw, which usually is furnished with the electrical fixture, is of insufficient length to permit such stacking, creating a further problem. This is commonly obviated in inexpensive electrical fixtures, such as building outlets and switches, by providing a pair of adjacent screws on a terminal, one for a feeder wire end and the adjacent one for another wire end which joins the next parallel electric fixture. This is only a partial solution, since it is sometimes desirable to connect a third or a fourth wire end to the terminal, again requiring stacking of the wire end loops. It will, thus, be further apparent that if two wire ends could be attached here with a screw head without stacking, further advantage would be attained.

It has also been the practice to splice wire ends with devices which employ set screws, wire clamps, and the like, which are complicated and expensive and designed only for this purpose. It will be further apparent, accordingly, that if a device could be devised the serve as a termminal connector, as previously referred to, and also serve a second purpose of providing a splicer between wire ends, further advantage would be attained by elimination of a single purpose device.

The prior art screw and threaded terminal type connector above referred to, to which the present invention probably most closely appertains, is thus somewhat lacking in optimum utility in that the wire end must be curled or looped to provide a satisfactory connection, requiring additional operations for assembly or disassembly. It also has a single purpose, since it is part of a fixture, such as a plug outlet switch, etc., which are too cumbersome for use as a splicer. As will subsequently appear in more detail, this art is advanced by the provision of a clamping device whhich may be employed with the former screw, serve a like purpose in an improved manner, and also serve as a wire splicer with the use of a simple screw and nut when desired, furthr adding to its versatility.

SUMMARY OF THE INVENTION

A mass producible inexpensive electrical connector for wires which are secured to a terminal or the like by a clamping screw. A clip, which is disposed between the screw head and terminal, comprises a strip of metal bent into a loop with parallel legs through which the screw extends. The ends of the legs are closed by bight portions which serve as slightly deformable abutments to permit the legs to be squeezed toward each other, with a wire end, or a pair of wire ends, therebetween, so that the plane of the screw head remains parallel with the legs, thus obviating eccentric forces on the screw which tend to bend it or adversely engage its mating threads in the terminal. The legs are preferably spaced apart the diameter of the wire end so that when clamped it is resiliently secured by the screw and may be released by loosening same. With slight modifications or with choice thereof, a single wire or a pair thereof may be secured or wires of different diameters may be secured. Also, it may be employed as a splicer between ends of two wires which are not connected to a terminal by substituting a nut for the threads in a terminal.

In accordance with the foregoing, the objects include:

Provision of a connector which secures a straight end of a wire to a terminal without requiring bending thereof into a partial loop beneath a terminal screw head.

Provision of a connector for use with the straight end or ends of one or two wires.

Provision of a connector for forming a splice between ends of a conductor which is not connected at the splice to a terminal.

Provision of a connector, which by choice of combination of sized may connect wires of different diameters to a terminal or splice wires of different diameters.

Other objects, advantages, and salient features will become more apparent from the detailed description to follow, the appended claims, and the accompanying drawing to now be briefly described.

DESCRIPTION OF PREFERRED EMBODIMENTS

Figure 1:
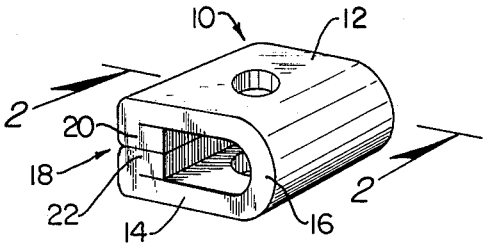
FIG. 1 is an isometric view of one form of connector clip for use with a single conductor end.
Figure 2:
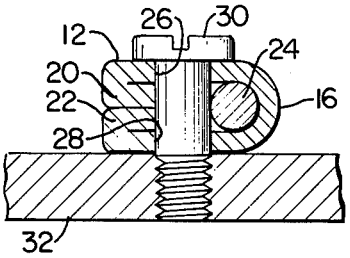
FIG. 2 is a section taken on the central plane 2—2 of FIG. 1.

Referring now to the drawing in greater detail, and first to FIGS. 1 and 2, connector 10 is formed from metallic strip stock, rectangular in cross section and so bent to provide spaced parallel legs 12, 14 connected together at one end by a semi-circular bight 16. Bight 18, at the other end, is formed by abutting folds 20, 22. The thickness of the material is preferably about one-half the diameter of a wire to be disposed adjacent bight 16. Thus, two abutting folds produce a spacing between legs of about the diameter of the wire so that a pared end 24 of an insulated wire may be readily slid between the legs. Aligned apertures 26, 28 are provided intermediate the ends of the legs, preferably centrally thereof through which the shank of a headed screw 30 extends. As will be apparent, when the screw is tightened in terminal 32, legs 12, 14 are squeezed relatively toward each other tightly engaging the wire at diametrically opposite points thereon. Bight 18 serves a like purpose at the opposite end of the legs, preventing uneven collapse thereof so that the legs remain substantially parallel and with the entire periphery of the head of the screw engaging leg 12, thus obviating any eccentric force on the screw shank which would tend to bend or cause it to move in its mating threads in terminal 32 in a non-axial direction. It, thus, maintains the screw in like relationship to a partial or complete loop in the wire as previously referred to in connection with the prior art.

Figure 3:
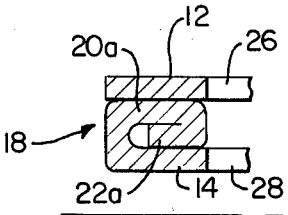
FIG. 3 is a modification of the left portion of FIGS. 1 and 2.

Referring now to FIG. 3, this construction is the same as that of FIGS. 1 and 2, except that bight 18 is formed by two folds 20*a*, 22*a* formed on only one of the legs.

Figure 4:
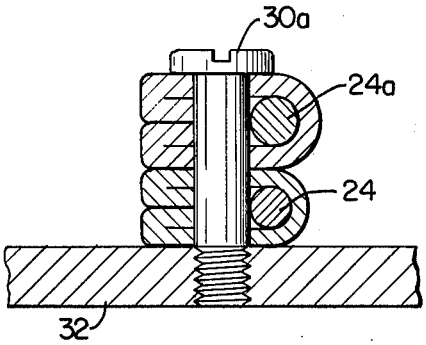
FIG. 4 is a section, like FIG. 2, illustrating a pair of stacked connector clips.

FIG. 4 illustrates a pair of clips in stacked relation on terminal 32 and secured thereto by screw 30*a*, which is of suitable length. As illustrated, the lower clip is the same as in FIGS. 1 and 2, but the upper clip is so dimensioned to receive a larger wire end, 24*a*. As will be apparent, the selection of the particular size clips will depend on the wire size. Also, more than two may be employed by selection of a screw of suitable length.

Figure 5:
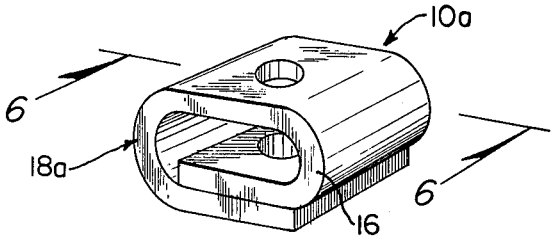
FIG. 5 is an isometric view, like FIG. 1 of another form of connector clip for use with a pair of conductor ends.
Figure 6:
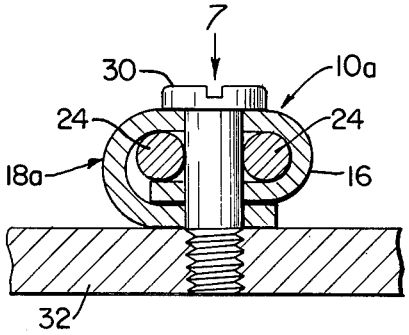
FIG. 6 is a section taken on the central plane, 6—6 of FIG. 5.
Figure 7:
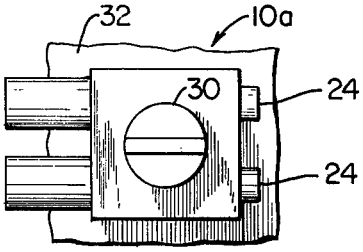
FIG. 7 is a top plan of FIG. 6, as viewed in the direction of arrow 7.

FIGS. 5 to 7 illustrate an alternative form of the clip so far described. In this construction, bight 16 is the same but bight 18*a* is so bent to receive a second wire end 24 between same and the screw, thus permitting two wire ends to be connected to terminal 32. In addition to its utility to secure two wire ends to a terminal, it may, if so desired, be employed to secure only one wire end thereto by inserting a short length of uninsulated wire into the clip at one side of the screw, which then becomes equivalent to the folds forming the bight or abutment 18 of the single connector of FIGS. 1–4.

Figure 8:
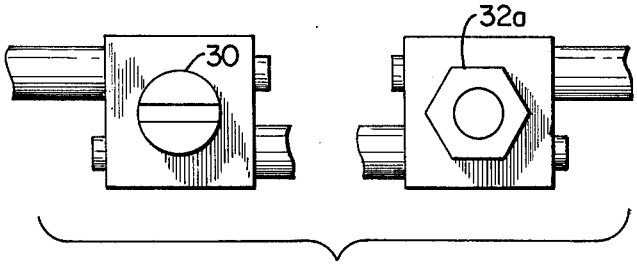
FIG. 8 is a like view illustrating opposite sides of a clip when employed to splice adjacent ends at a conductor.

The clip of FIGS. 5–7 also has further versatility as a splicer, as illustrated in FIG. 8. In this construction, a nut 32*a* is employed instead of terminal 32 and intermediate ends of the same conductive wire are secured together by the clip, screw and nut, after which the assembly will usually be insulated by tape, shrinkable tubing or the like (not shown). As will be apparent, the wire ends may be inserted into opposite ends of the clip, as illustrated, or into the same end (not shown).

Various modifications within the purview of the invention will now become apparent to those skilled in the art. For example, in the form of the invention illustrated in FIGS. 1–4, the thickness of the material is one-half the wire diameter. The reason for this is that two folds in bight or abutment 18 are illustrated. It may be desired, however, to employ material thinner than one-half diameter to permit the legs to be more readily squeezed toward each other by the screw. To attain this, thinner material may be employed and the number of folds increased. As an example, in the FIG. 3 construction, folds like 20*a*, 22*a* could also be provided on upper leg 12, thus forming an abutment thickness of four folds in which case the thickness of the material would become one-quarter of the wire diameter, rather than one-half the wire diameter, as shown. Abutment thickness equal to wire diameter my also be attained by a suitable bend or bends in the material, other than by the retroverted folds illustrated so that material thickness may be chosen as desired.

In the two wire connectors of FIGS. 5–8, it will be apparent that the material thickness may be as desired, since each wire forms an abutment for the other at each side of the screw.

What I claim is:

1. A terminal clip for use with the straight end of a circular electrical wire, comprising:
   a. an elongated strip of metal of uniform thickness having an integral bend between its ends to form a pair of parallel legs of equal length and spaced apart substantially the diameter of the wire;
   b. said bend having an inner semi-circular surface adjacent which said straight end is adapted to lie;
   c. a bent extension on the end of at least one of said legs, forming an abutment therebetween adapted to prevent movement of the legs toward each other at their abutting locus;
   d. a pair of aligned apertures in said legs disposed at one side of the abutment through which the shank of a flat headed screw is adapted to extend, said straight end adapted to be disposed between one side of the screw shank and said semi-circular surface, the distance between one side of the screw shank and the semicircular surface, at a point midway between the legs, being substantially one diameter of the wire, the head of the screw being of such size that one side thereof may engage one leg at a locus above the abutment and its opposite side may engage said one leg at a locus above the wire; and
   e. the construction and arrangement being such that said legs may be moved slightly toward each other by the screw head at the locus above the wire to clamp same thereto but are prevented from such movement at the locus above the abutment, whereby the legs remain substantially parallel and the screw is not subjected to bending when tightened.

2. A clip in accordance with claim 1 wherein each leg is provided with a bent extension, bent 180° inwardly and into contact with its respective leg and the thickness of the strip is substantially one-half the diameter of the wire, whereby the two abutting bent extensions limit the spacing of the legs to substantially one diameter of the wire.

3. A clip in accordance with claim 1 wherein one leg is provided with a bent extension, bent with two 180° bends in contact with each other and the thickness of the strip is substantially one-half the diameter of the wire, whereby the two 180° bends limit the spacing of the legs to substantially one diameter of the wire.

* * * * *